US011317678B2

(12) United States Patent
Bock et al.

(10) Patent No.: US 11,317,678 B2
(45) Date of Patent: May 3, 2022

(54) SHOE WITH LACING MECHANISM

(71) Applicant: PUMA SE, Herzogenaurach (DE)

(72) Inventors: Markus Bock, Herzogenaurach (DE); Randolph Maussner, Spalt (DE)

(73) Assignee: PUMA SE, Herzogenaurach (DE)

( * ) Notice: Subject to any disclaimer, the term of this patent is extended or adjusted under 35 U.S.C. 154(b) by 68 days.

(21) Appl. No.: 16/919,940

(22) Filed: Jul. 2, 2020

(65) Prior Publication Data

US 2020/0345108 A1 Nov. 5, 2020

Related U.S. Application Data

(63) Continuation of application No. 15/780,368, filed as application No. PCT/EP2015/002425 on Dec. 2, 2015.

(51) Int. Cl.

| | |
|---|---|
| ***A43C 11/16*** | (2006.01) |
| ***A43C 11/00*** | (2006.01) |
| ***A43B 11/00*** | (2006.01) |
| ***B65H 59/38*** | (2006.01) |
| ***A43B 3/34*** | (2022.01) |
| *A43B 3/00* | (2022.01) |

(52) U.S. Cl.

CPC ..... *A43C 11/165* (2013.01); *A43B 3/34* (2022.01); *A43B 11/00* (2013.01); *A43C 11/00* (2013.01); *A43C 11/008* (2013.01); *B65H 59/384* (2013.01)

(58) Field of Classification Search

CPC ..... A43C 11/165; A43B 3/005; A43B 11/00; B65H 59/384

See application file for complete search history.

(56) References Cited

U.S. PATENT DOCUMENTS

| | | | |
|---|---|---|---|
| 4,724,626 | A | 2/1988 | Baggio |
| 4,741,115 | A | 5/1988 | Pozzobon |

(Continued)

FOREIGN PATENT DOCUMENTS

| | | | |
|---|---|---|---|
| CA | 2500150 | A1 | 9/2006 |
| CN | 2540805 | Y | 3/2003 |

(Continued)

OTHER PUBLICATIONS

The First Office Action issued in corresponding Chinese Application No. 201680091000.4, dated Jun. 5, 2020, 19 pages.

(Continued)

*Primary Examiner* — Alissa L Hoey
*Assistant Examiner* — Patrick J. Lynch
(74) *Attorney, Agent, or Firm* — Quarles & Brady LLP

(57) ABSTRACT

A shoe is disclosed that includes an upper having a closure mechanism that is arranged for lacing the shoe by at least one tensioning element, a rotatably arranged tensioning roller disposed within the closure mechanism, the tensioning roller being driven by an electric motor, and a closing button in communication with a control system for generating a closing signal that is configured to actuate the electric motor to lace the shoe. The closure mechanism is configured to tighten the shoe with a first level of lacing power when a first closing signal is generated and tighten the shoe with a second level of lacing power when a second closing signal is generated.

21 Claims, 2 Drawing Sheets

(56) References Cited

U.S. PATENT DOCUMENTS 4,748,726 A 6/1988 Schoch
4,787,124 A 11/1988 Pozzobon et al.
4,922,634 A 5/1990 Seidel
4,961,544 A 10/1990 Bidoia
5,051,095 A 9/1991 Slenker
5,206,804 A 4/1993 Thies et al.
5,325,613 A 7/1994 Sussmann
5,724,265 A 3/1998 Hutchings
5,839,210 A 11/1998 Bernier et al.
5,955,667 A 9/1999 Fyfe
5,983,530 A 11/1999 Chou
6,018,705 A 1/2000 Gaudet et al.
6,032,387 A 3/2000 Johnson
6,052,654 A 4/2000 Gaudet et al.
6,202,953 B1 3/2001 Hammerslag
6,289,558 B1 9/2001 Hammerslag
6,427,361 B1 8/2002 Chou
6,430,843 B1 8/2002 Potter et al.
6,691,433 B2 2/2004 Liu
6,865,825 B2 3/2005 Bailey, Sr. et al.
6,876,947 B1 4/2005 Darley et al.
6,882,955 B1 4/2005 Ohlenbusch et al.
6,892,477 B2 5/2005 Potter et al.
6,978,684 B2 12/2005 Nurse
7,082,701 B2 8/2006 Dalgaard et al.
7,096,559 B2 8/2006 Johnson
7,188,439 B2 3/2007 DiBenedetto et al.
7,310,895 B2 12/2007 Whittlesey et al.
7,503,131 B2 3/2009 Nadel et al.
7,607,243 B2 10/2009 Bemer, Jr. et al.
7,721,468 B1 5/2010 Johnson et al.
7,752,774 B2 7/2010 Ussher
7,794,101 B2 9/2010 Galica et al.
D648,110 S 11/2011 Rasmussen
8,046,937 B2 11/2011 Beers et al.
8,056,269 B2 11/2011 Beers et al.
8,058,837 B2 11/2011 Beers et al.
8,061,061 B1 11/2011 Rivas
8,074,379 B2 12/2011 Robinson, Jr. et al.
8,277,401 B2 10/2012 Hammerslag et al.
8,387,282 B2 3/2013 Baker et al.
8,424,168 B2 4/2013 Soderberg et al.
8,468,657 B2 6/2013 Soderberg et al.
8,474,146 B2 7/2013 Hartford et al.
8,516,662 B2 8/2013 Goodman et al.
D689,684 S 9/2013 McMillan
8,522,456 B2 9/2013 Beers et al.
8,528,235 B2 9/2013 Beers et al.
8,676,541 B2 3/2014 Schrock et al.
8,678,541 B2 3/2014 Uchiyama
8,713,820 B2 5/2014 Kerns et al.
8,739,639 B2 6/2014 Owings et al.
8,769,844 B2 7/2014 Beers et al.
D718,036 S 11/2014 McMillan
8,904,672 B1 12/2014 Johnson
8,904,673 B2 12/2014 Johnson et al.
8,935,860 B2 1/2015 Torres
9,072,341 B2 7/2015 Jungkind
D740,538 S 10/2015 Roulo
9,149,089 B2 10/2015 Cotterman et al.
9,204,690 B1 12/2015 Alt et al.
D746,558 S 1/2016 Campbell et al.
9,241,539 B1 1/2016 Keswin
9,248,040 B2 2/2016 Soderberg et al.
D750,879 S 3/2016 Klein et al.
9,301,573 B2 4/2016 Jasmine
9,307,804 B2 4/2016 Beers et al.
D756,621 S 5/2016 Weddle
9,326,566 B2 5/2016 Beers et al.
9,365,387 B2 6/2016 Beers et al.
9,380,834 B2 7/2016 Rushbrook et al.
D768,977 S 10/2016 Seamarks et al.
9,462,844 B2 10/2016 Schrock et al.
9,532,893 B2 1/2017 Beers et al.
9,578,926 B2 2/2017 Alt et al.
9,609,918 B2 4/2017 Beers
9,610,185 B2 4/2017 Capra et al.
9,629,418 B2 4/2017 Rushbrook et al.
9,693,605 B2 7/2017 Beers
9,706,814 B2 7/2017 Converse et al.
9,756,895 B2 9/2017 Rice et al.
9,763,489 B2 9/2017 Amos et al.
9,848,674 B2 12/2017 Smith et al.
9,861,164 B2 1/2018 Beers et al.
9,861,165 B2 1/2018 Schneider et al.
9,867,417 B2 1/2018 Beers et al.
9,872,539 B2 1/2018 Beers
9,907,359 B2 3/2018 Beers
9,918,865 B2 3/2018 Nickel et al.
D814,776 S 4/2018 Odinot
D815,413 S 4/2018 Weddle
9,943,139 B2 4/2018 Beers et al.
9,961,963 B2 5/2018 Schneider et al.
9,993,046 B2 6/2018 Bock
10,004,295 B2 6/2018 Gerber
10,010,129 B2 7/2018 Beers et al.
10,034,512 B2 7/2018 Rushbrook et al.
10,046,942 B2 8/2018 Beers et al.
10,070,681 B2 9/2018 Beers et al.
10,070,683 B2 9/2018 Rushbrook et al.
10,076,462 B2 9/2018 Johnson et al.
D829,425 S 10/2018 Albrecht et al.
10,085,517 B2 10/2018 Beers et al.
10,092,065 B2 10/2018 Rushbrook et al.
10,102,722 B2 10/2018 Levesque et al.
10,104,937 B2 10/2018 Beers et al.
10,111,496 B2 10/2018 Schneider et al.
10,201,212 B2 2/2019 Beers et al.
10,231,505 B2 3/2019 Beers et al.
10,238,180 B2 3/2019 Beers et al.
10,376,018 B2 8/2019 Rushbrook et al.
10,441,020 B1 10/2019 Ftndon et al.
2003/0009913 A1 1/2003 Potter et al.
2003/0150135 A1 8/2003 Liu
2004/0177531 A1 9/2004 DiBenedetto et al.
2005/0183292 A1 8/2005 DiBenedetto et al.
2005/0198867 A1 9/2005 Labbe
2006/0000116 A1 1/2006 Brewer
2006/0103538 A1* 5/2006 Daniel ..... G08B 25/016 340/574
2007/0000154 A1 1/2007 DiBenedetto et al.
2007/0006489 A1 1/2007 Case et al.
2007/0129907 A1 6/2007 Demon
2007/0164521 A1 7/2007 Robinson
2007/0260421 A1 11/2007 Berner et al.
2007/0271817 A1 11/2007 Ellis
2008/0066272 A1 3/2008 Hammerslag et al.
2008/0301919 A1 12/2008 Ussher
2009/0184189 A1 7/2009 Soderberg et al.
2009/0193689 A1 8/2009 Galica et al.
2009/0272007 A1* 11/2009 Beers ..... A43C 11/00 36/50.1
2009/0272013 A1 11/2009 Beers et al.
2010/0063778 A1 3/2010 Schrock et al.
2010/0063779 A1 3/2010 Schrock et al.
2010/0139057 A1 6/2010 Soderberg et al.
2010/0289971 A1 11/2010 Odland et al.
2011/0025704 A1 2/2011 Odland et al.
2011/0175744 A1 7/2011 Englert et al.
2011/0225843 A1 9/2011 Kerns et al.
2011/0232134 A1 9/2011 Radl et al.
2011/0266384 A1 11/2011 Goodman et al.
2012/0000091 A1 1/2012 Cotterman et al.
2012/0004587 A1 1/2012 Nickel et al.
2012/0124500 A1 5/2012 Hunter
2012/0185801 A1 7/2012 Madonna et al.
2013/0092780 A1 4/2013 Soderberg et al.
2013/0104429 A1 5/2013 Torres
2013/0213147 A1 8/2013 Rice et al.
2013/0312293 A1 11/2013 Gerber
2014/0068838 A1 3/2014 Beers et al.
2014/0070042 A1 3/2014 Beers et al.
2014/0082963 A1 3/2014 Beers
2014/0257156 A1 9/2014 Capra et al.

(56) References Cited

U.S. PATENT DOCUMENTS

| | | | |
|---|---|---|---|
| 2014/0292396 | A1 | 10/2014 | Bruwer et al. |
| 2015/0007422 | A1 | 1/2015 | Cavanagh et al. |
| 2015/0185764 | A1 | 7/2015 | Magi |
| 2015/0250268 | A1 | 9/2015 | Alt et al. |
| 2015/0289594 | A1 | 10/2015 | Rushbrook et al. |
| 2016/0027297 | A1 | 1/2016 | Wu et al. |
| 2016/0157561 | A1 | 6/2016 | Schum et al. |
| 2016/0256349 | A1 | 9/2016 | Mayer et al. |
| 2016/0262485 | A1 | 9/2016 | Walker |
| 2016/0345654 | A1 | 12/2016 | Beers et al. |
| 2016/0345679 | A1 | 12/2016 | Beers et al. |
| 2016/0345681 | A1 | 12/2016 | Pheil et al. |
| 2016/0360828 | A1 | 12/2016 | Guyan |
| 2017/0035151 | A1 | 2/2017 | Peyton et al. |
| 2017/0150773 | A1 | 6/2017 | Beers |
| 2017/0215524 | A1 | 8/2017 | Rushbrook et al. |
| 2017/0265572 | A1 | 9/2017 | Beers et al. |
| 2017/0265573 | A1 | 9/2017 | Beers et al. |
| 2017/0265574 | A1 | 9/2017 | Beers et al. |
| 2017/0265575 | A1 | 9/2017 | Beers et al. |
| 2017/0265576 | A1 | 9/2017 | Beers et al. |
| 2017/0265577 | A1 | 9/2017 | Schneider |
| 2017/0265578 | A1 | 9/2017 | Schneider |
| 2017/0265579 | A1 | 9/2017 | Schneider et al. |
| 2017/0265580 | A1 | 9/2017 | Schneider et al. |
| 2017/0265581 | A1 | 9/2017 | Chang |
| 2017/0265582 | A1 | 9/2017 | Walker et al. |
| 2017/0265583 | A1 | 9/2017 | Schneider et al. |
| 2017/0265584 | A1 | 9/2017 | Walker et al. |
| 2017/0265585 | A1 | 9/2017 | Orand |
| 2017/0265586 | A1 | 9/2017 | Schneider et al. |
| 2017/0265587 | A1 | 9/2017 | Walker et al. |
| 2017/0265588 | A1 | 9/2017 | Walker et al. |
| 2017/0265589 | A1 | 9/2017 | Walker et al. |
| 2017/0265591 | A1 | 9/2017 | Schneider |
| 2017/0265594 | A1 | 9/2017 | Walker et al. |
| 2017/0267485 | A1 | 9/2017 | Schneider et al. |
| 2017/0272008 | A1 | 9/2017 | Schneider |
| 2017/0295889 | A1 | 10/2017 | Beers |
| 2017/0303643 | A1 | 10/2017 | Converse et al. |
| 2017/0312161 | A1 | 11/2017 | Johnson et al. |
| 2017/0318908 | A1 | 11/2017 | Wyatt et al. |
| 2017/0332734 | A1 | 11/2017 | Orand |
| 2017/0332735 | A1 | 11/2017 | Orand et al. |
| 2017/0340049 | A1 | 11/2017 | Rice et al. |
| 2018/0020764 | A1 | 1/2018 | Walker |
| 2018/0035760 | A1 | 2/2018 | Bock |
| 2018/0110288 | A1 | 4/2018 | Hatfield et al. |
| 2018/0110294 | A1 | 4/2018 | Schneider et al. |
| 2018/0110298 | A1 | 4/2018 | Schneider et al. |
| 2018/0116326 | A1 | 5/2018 | Beers et al. |
| 2018/0125168 | A1 | 5/2018 | Beers et al. |
| 2018/0153260 | A1 | 6/2018 | Beers |
| 2018/0153263 | A1 | 6/2018 | Beers et al. |
| 2018/0199674 | A1 | 7/2018 | Walker et al. |
| 2018/0219403 | A1 | 8/2018 | Schneider |
| 2018/0228250 | A1 | 8/2018 | Beers et al. |
| 2018/0263340 | A1 | 9/2018 | Schneider et al. |
| 2018/0289110 | A1 | 10/2018 | Bock et al. |
| 2018/0310644 | A1 | 11/2018 | Poupyrev et al. |
| 2018/0310659 | A1 | 11/2018 | Poupyrev et al. |
| 2018/0310670 | A1 | 11/2018 | Rovekamp, Jr. et al. |
| 2018/0317609 | A1 | 11/2018 | Beers et al. |
| 2018/0343977 | A1 | 12/2018 | Riccomini et al. |
| 2018/0343978 | A1 | 12/2018 | Stillman et al. |
| 2018/0368526 | A1 | 12/2018 | Bock et al. |
| 2018/0368528 | A1 | 12/2018 | Beers et al. |
| 2019/0246745 | A1 | 8/2019 | Bock et al. |
| 2019/0246746 | A1 | 8/2019 | Bock et al. |
| 2019/0246747 | A1 | 8/2019 | Bock et al. |
| 2020/0046079 | A1 | 2/2020 | Rushbrook et al. |

FOREIGN PATENT DOCUMENTS

| | | | |
|---|---|---|---|
| CN | 201222723 | Y | 4/2009 |
| CN | 102058197 | A | 5/2011 |
| CN | 202907266 | U | 4/2013 |
| CN | 104585975 | A | 5/2015 |
| CN | 104822284 | A | 8/2015 |
| CN | 105278768 | A | 1/2016 |
| DE | 29701491 | U1 | 5/1998 |
| DE | 29817003 | U1 | 3/1999 |
| DE | 19833801 | A1 | 2/2000 |
| DE | 102005014709 | A1 | 10/2006 |
| DE | 102005036013 | A1 | 2/2007 |
| DE | 102005052903 | A1 | 5/2007 |
| EP | 0614624 | A1 | 9/1994 |
| EP | 2871994 | A1 | 5/2015 |
| EP | 3046434 | A1 | 7/2016 |
| FR | 2924577 | A1 | 6/2009 |
| GB | 2449722 | A | 12/2008 |
| JP | 3005659 | U | 1/1995 |
| JP | 3195320 | B2 | 8/2001 |
| JP | 2004267784 | A | 9/2004 |
| JP | 2004275201 | A | 10/2004 |
| JP | 2009011460 | A | 1/2009 |
| JP | 2011519611 | A | 7/2011 |
| JP | 5486203 | B2 | 5/2014 |
| JP | 2016530058 | A | 9/2016 |
| KR | 100398822 | B1 | 9/2003 |
| KR | 1020050122149 | A | 12/2005 |
| WO | 1998011797 | A1 | 3/1998 |
| WO | 2008033963 | A2 | 3/2008 |
| WO | 2009134858 | A1 | 11/2009 |
| WO | 2012109244 | A1 | 8/2012 |
| WO | 2014036374 | A1 | 3/2014 |
| WO | 2014082652 | A1 | 6/2014 |
| WO | 2015014374 | A1 | 2/2015 |
| WO | 2015042216 | A1 | 3/2015 |
| WO | 2015045598 | A1 | 4/2015 |
| WO | 2015056633 | A1 | 4/2015 |
| WO | 2015160406 | A1 | 10/2015 |
| WO | 2015160768 | A1 | 10/2015 |
| WO | 2015160790 | A1 | 10/2015 |
| WO | 2015163982 | A1 | 10/2015 |
| WO | 2016057697 | A1 | 4/2016 |
| WO | 2016191115 | A1 | 12/2016 |
| WO | 2016191117 | A1 | 12/2016 |
| WO | 2016191123 | A1 | 12/2016 |
| WO | 2016195957 | A1 | 12/2016 |
| WO | 2016195965 | A1 | 12/2016 |
| WO | 2017059876 | A1 | 4/2017 |
| WO | 2017091769 | A1 | 6/2017 |
| WO | 2017092775 | A1 | 6/2017 |
| WO | 2017095945 | A1 | 6/2017 |
| WO | 2017158410 | A1 | 9/2017 |
| WO | 2017160534 | A2 | 9/2017 |
| WO | 2017160536 | A2 | 9/2017 |
| WO | 2017160558 | A2 | 9/2017 |
| WO | 2017160561 | A2 | 9/2017 |
| WO | 2017160563 | A2 | 9/2017 |
| WO | 2017160657 | A2 | 9/2017 |
| WO | 2017160708 | A2 | 9/2017 |
| WO | 2017160865 | A1 | 9/2017 |
| WO | 2017160866 | A1 | 9/2017 |
| WO | 2017160881 | A1 | 9/2017 |
| WO | 2017160969 | A1 | 9/2017 |
| WO | 2017161000 | A2 | 9/2017 |
| WO | 2017161014 | A1 | 9/2017 |
| WO | 2017161037 | A1 | 9/2017 |
| WO | 2017161044 | A1 | 9/2017 |
| WO | 2017164612 | A1 | 9/2017 |
| WO | 2017185160 | A1 | 11/2017 |
| WO | 2017189926 | A1 | 11/2017 |
| WO | 2017197627 | A1 | 11/2017 |
| WO | 2017091769 | A8 | 1/2018 |
| WO | 2018028380 | A1 | 2/2018 |
| WO | 2018028381 | A1 | 2/2018 |
| WO | 2018081260 | A1 | 5/2018 |
| WO | 2018094156 | A1 | 5/2018 |
| WO | 2018095500 | A1 | 5/2018 |

(56) References Cited

FOREIGN PATENT DOCUMENTS

| | | | |
|---|---|---|---|
| WO | 2018095501 | A1 | 5/2018 |
| WO | 2018120085 | A1 | 7/2018 |
| WO | 2017161000 | A3 | 8/2018 |
| WO | 2018170148 | A2 | 9/2018 |
| WO | 2018170148 | A3 | 11/2018 |
| WO | 2018222805 | A2 | 12/2018 |
| WO | 2018222807 | A2 | 12/2018 |
| WO | 2018222836 | A2 | 12/2018 |

OTHER PUBLICATIONS

Invitation to Pay Additional Fees and Communication Relating to Results of Partial International Search Report from corresponding PCT Application No. PCT/IB2020/058424 dated Dec. 8, 2020 (12 pages).
International Search Report of International Application No. PCT/EP2016/001968, dated Jul. 31, 2017, 6 pages.
Written Opinion of International Application No. PCT/EP2016/001968, dated Jul. 31, 2017, 6 pages.
International Preliminary Report on Patentability (Form IPEA/409) of International Application No. PCT/EP2016/001968, dated Jan. 9, 2019, 31 pages.
International Search Report of International Application No. PCT/EP2016/001967, dated Jul. 26, 2017, 7 pages.
Written Opinion of International Application No. PCT/EP2016/001967, dated Jul. 26, 2017, 6 pages.
International Preliminary Report on Patentability (Form IPEA/409) of International Application No. PCT/EP2016/001967, dated Jan. 4, 2019, 23 pages.
Andrew Liszewski: "A Self-Adjusting Smart Bell: Yes, It's Come to This", Jan. 4, 2015 (Jan. 4, 2015), Retrieved from the Internet: URL: https://gixmodo.com/the-only-gdget-the-world-really-needs-is-a-self-adjust-1677432880 [retrieved on May 16, 2019], 3 pages.
International Search Report of International Application No. PCT/EP2015/001963, dated Aug. 9, 2016, 5 pages.
Notice of Reasons for Refusal issued in Japanese Application No. 2018-524270, dated Dec. 3, 2019, 9 pages.
Search Report by Registered Search Organization issued in Japanese Application No. 2018-524270, dated Nov. 27, 2019, 128 pages.
International Search Report and Written Opinion of International Application No. PCT/IB2020/053777, dated Jun. 18, 2020, 12 pages.
International Search Report and Written Opinion of International Application No. PCT/IB2020/053778, dated Jun. 18, 2020, 14 pages.
The First Office Action issued in corresponding Chinese Application No. 201580084987.2, dated May 6, 2020, 25 pages.
Japanese Office Action from corresponding Japanese Patent Application No. 2019-525884, dated Aug. 25, 2020 (English translation included) (8 pages).
First Office Action from corresponding Chinese Patent Application No. 201680091016.5, dated Oct. 22, 2020 (15 pages).

* cited by examiner

SHOE WITH LACING MECHANISM

CROSS-REFERENCE TO RELATED APPLICATION

The present application is a continuation of U.S. application Ser. No. 15/780,368, filed on May 31, 2018, which is a 371 of International Application PCT/EP2015/002425, filed on Dec. 2, 2015, the priority of these applications is herein claimed and the entire contents of which being incorporated herein by reference.

BACKGROUND OF THE DISCLOSURE

The invention relates to a method for lacing a shoe, especially a sports shoe, wherein the shoe comprises:

an upper, wherein at or on the upper a rotating closure is arranged for lacing the shoe at the foot of the wearer by means of at least one tensioning element, wherein the rotating closure comprises a rotatably arranged tensioning roller, wherein the tensioning roller is driven by means of an electric motor, wherein the rotating closure has or comprises furthermore at least one closing button which closing button is connected to a control system which actuates the electric motor, wherein the lacing of the shoe is carried out by the user of the shoe generating a closing signal by means of the closing button.

A shoe with an electric motor operated rotating closure is known from DE 298 17 003 U1. Here, a tensioning roller is electric motor operated for winding of a tensioning element so that the shoe can be laced and de-laced automatically.

For lacing of the shoe an electric switch is operated by the user and the electric motor of the rotating closure is activated so long as the switch is pressed. Correspondingly, the tensioning force rises gradually. When a desired tensioning force level is reached the switch is released by the user. For de-lacing of the shoe another switch can be actuated respectively.

Accordingly the lacing of the shoe requires a respective time while the switch must be pressed by the user. Furthermore, the desired tensioning force level must be adjusted by the user at each lacing.

A method of the generic kind is disclosed in WO 2014/036374 A1. Similar and other solutions are shown in US 2014/0082963 A1 and US 2015/0289594 A1.

SUMMARY OF THE DISCLOSURE

It is the object of the invention to further develop a method of the above-mentioned kind in such a manner that the lacing of the shoe can be carried out more comfortable and in an easier manner. Thereby, it should be especially possible to adapt the lacing of the shoe to individual requirements conveniently. By doing so it should be possible to put on the shoe according to the desired requests of the user with a definite tensioning force level without a high handling effort.

The solution of this object by the invention is characterized in that the method comprises the steps:

lacing the shoe with a first level of lacing power, resulting in a first tension of the at least one tensioning element, when the user of the shoe generates a first closing signal by means of the closing button, wherein the first closing signal is a singular tap on the closing button to which no further tap impulse follows within a predetermined waiting time, or alternatively and additive respectively.

lacing the shoe with a second level of lacing power, resulting in a second tension of the at least one tensioning element, which is higher than the first tension, when the user of the shoe generates a second closing signal by means of the closing button, which is different from the first closing signal, wherein the second closing signal is a done twice tap on the closing button, wherein the two tap impulses follow within a predetermined following time and wherein no further tap impulse follows within a predetermined waiting time to the done twice tap.

In continuation of this concept it can further be provided that the method comprises alternatively and additive respectively the further step:

lacing the shoe with a third level of lacing power, resulting in a third tension of the at least one tensioning element, which is higher than the second tension, when the user of the shoe generates a third closing signal by means of the closing button, which is different from the first and second closing signal.

After obtaining of the first or second level of lacing power in dependence of the applied closing signal according to a further embodiment the step can be carried out:

increasing of the level of lacing power from the first level of lacing power to the second level of lacing power or from the second level of lacing power to the third level of lacing power when the user of the shoe generates a further closing signal by means of the closing button.

This further closing signal is preferably a singular tap on the closing button.

Accordingly, the proposed concept offers at first the possibility to reach different lacing force levels electric motor operated, wherein the respective level of lacing power is obtained by entry of an individual closing signal. Is the first or second level of lacing power already reached and a further signal is entered by the user to the closing button a level of lacing power with higher tensioning force is obtained automatically.

Preferably, the third closing signal is a triple tap on the closing button, wherein each two of the tap impulses follow within a predetermined following time and wherein no further tap impulse follows within a predetermined waiting time to the triple tap.

The waiting time is preferably at the most 1.0 seconds.

The following time is preferably between 0.05 seconds and 0.75 seconds, specifically preferred between 0.1 seconds and 0.5 seconds.

The first level of lacing power is thereby preferably defined by a first predetermined maximum current which is pretended to the electric motor by the control system at the lacing process; said current is thereby preferably between 1.1 A and 1.9 A.

Analogue, the second level of lacing power is preferably defined by a second predetermined maximum current which is pretended to the electric motor by the control system at the lacing process, wherein the second maximum current is higher than the first maximum current; said current is preferably between 2.1 A and 2.9 A.

The third level of lacing power is correspondingly preferred defined by a third predetermined maximum current which is pretended to the electric motor by the control system at the lacing process, wherein the third maximum current is higher than the second maximum current; the current is preferably between 3.1 A and 3.9 A.

The control system can also initiates the tension relief of the at least one tensioning element when an opening button is actuated which is different from the closing button.

Thereby, preferably a rotating closure is used at which a gearing is arranged between the tensioning element and the electric motor.

The rotating closure is preferably arranged on the instep of the shoe. The axis of rotation of the tensioning roller is thereby preferably perpendicular to the surface of the shoe in the region of the instep.

Furthermore, a preferred embodiment provides a rotating closure at which the closing button and if applicable the opening button are arranged on the rotating closure.

As a special embodiment of the invention a control system can be used which is in connection with a mobile phone (smart phone) via a wireless connection, especially via a Bluetooth connection, wherein the closing button and if applicable the opening button are formed by the mobile phone. Accordingly, the control of the rotating closure can take place wireless via Bluetooth by a smart phone which is supplied with a respective app for this purpose.

The axis of rotation of the electric motor is preferably horizontally and transverse to the longitudinal direction of the shoe.

The tensioning elements are preferably tensioning wires. They can comprise polyamide or can consist of this material.

The battery which is required for the operation of the motor is preferably a rechargeable battery. The same can be supplied with a charging current by means of an induction coil. The battery can be arranged in a midsole of the shoe. The electronic system which is required for recharging can be arranged directly at the battery. By the provision of an induction coil the battery can be recharged contactless. For doing so the shoe can be placed on a respective recharging plate and so the battery can be recharged.

Accordingly, the proposed concept is basing on the idea to drive the motorized rotating closure to defined closing positions and tensioning force levels respectively by different signals (thus for example a singular tap, a done twice tap and a triple tap respectively onto the closing button). Said tensioning force levels are thereby preferably defined by presetting of a respective motor current (for example first level: 1.5 A—second level: 2.5 A—third level: 3.5 A) so that the motor is operated with corresponding maximum torques which delivers via the used gearing in turn a corresponding rising tensioning force in the tensioning element.

A multiple tap onto the closing button is recognized by the control system by the fact that the tap impulses have a maximum timed distance (see the above mentioned following time); furthermore, the signal which is desired from the user of the shoe is recognized by the fact that after the registered tap impulses no further impulse is detected during a predetermined waiting time.

Beside this direct reaching of the (three) mentioned tensioning force levels it is also possible after putting on the shoe to obtain the next higher tensioning force level by a singular tap.

The (complete) opening of the lacing can take place in one step after the actuation of a respective opening button. For the complete de-laced end position the tensioning roller can be supplied with a rotation angle sensor which can detect the zero-position of the tensioning roller.

Of course, the above described method can also be realized with more than three different tensioning power levels.

So, the operating comfort can be improved in a beneficial manner at the use of a shoe with electro motor operated lacing system by means of a rotating closure.

BRIEF DESCRIPTION OF THE DRAWINGS

In the drawing an embodiment of the invention is shown.

DETAILED DESCRIPTION OF THE INVENTION

Figure 1:
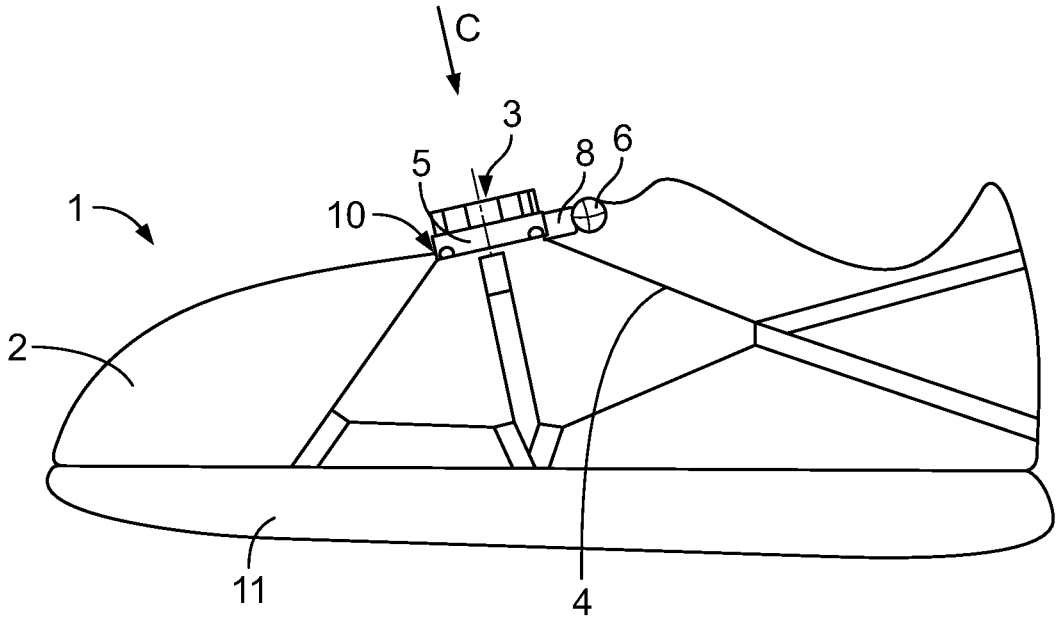
FIG. 1 shows schematically a side view of a sport shoe which can be laced with a rotating closure.

In FIG. 1 a shoe 1 being a sports shoe can be seen which has an upper 2 and a sole 11. The lacing of the shoe 1 takes place by means of a rotating closure 3 (i.e. of a central fastener), wherein by rotating of a tensioning roller 5 at least one tensioning element 4 is winded on the tensioning roller 5 and thus the upper 2 is tensioned and laced respectively at the foot of the wearer of the shoe 1.

Figure 2:
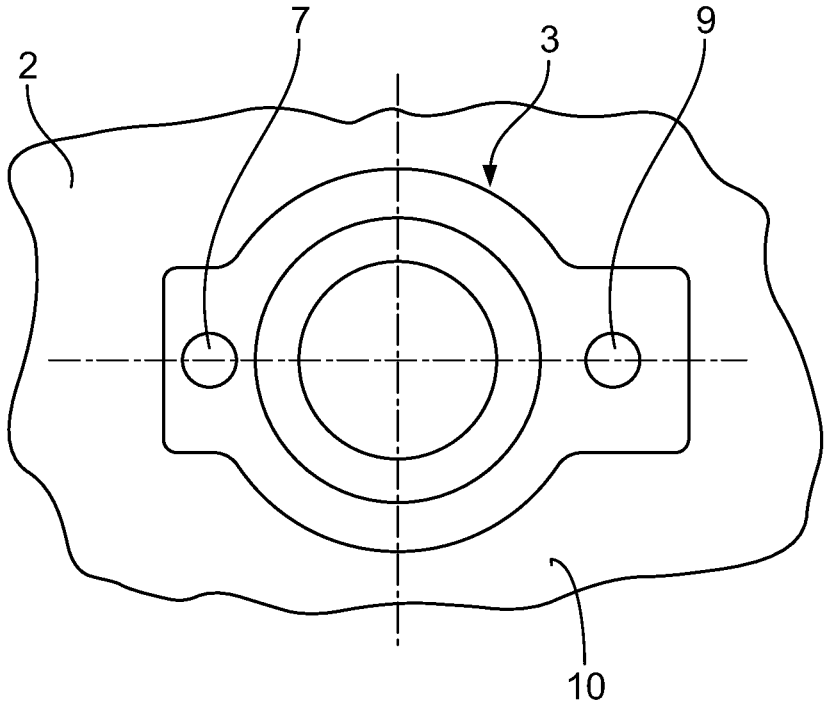
FIG. 2 shows schematically in the view C according to FIG. 1 a part of the instep of the shoe on which a rotating closure is arranged which can be actuated by a closing button and an opening button.

The rotating closure 3 is arranged on the instep 10 of the shoe 1. The axis of rotation of the tensioning roller is thereby perpendicular to the region of the instep 10 of the shoe 1. Accordingly, a convenient access to the rotating closure 3 is ensured for the user of the shoe who must only actuate corresponding buttons, namely a closing button 7 and an opening button 9 (s. FIG. 2), for opening and closing of the rotating closure because the rotating closure 3 is electric motor operated. The electric motor 6 is indicated which is required for that; it can drive the tensioning roller 5 via a—not depicted—gear. In the embodiment the axis of rotation of the electric motor 6 is arranged horizontally and transverse to the longitudinal direction of the shoe.

The actuation of the electric motor 6 for the opening and the closing of the rotating closure 3 is initiated by a control system 8 which is correspondingly also connected with the closing button 7 and the opening button 9.

Figure 3A:
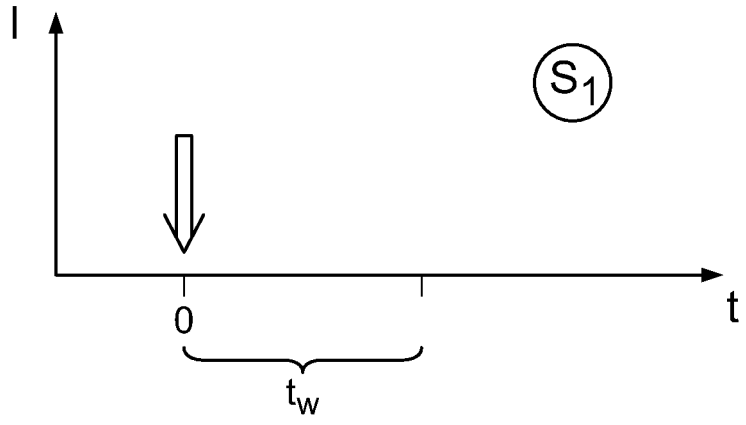
FIG. 3*a* shows a schematic depiction of a first closing signal for the rotating closure.

For closing of the shoe 1 the user proceeds as follows:

When he wants to put on the shoe at his foot with a first (low) tensioning force level he taps once onto the closing button 7. This tap impulse is denoted in FIG. 3*a* with the arrow. The control system 8 registers the tap impulse and waits a waiting time tW to find out if further tap impulses follow by the user. If this is not the case the software which is stored in the control system 8 knows that the user wanted to give a first closing signal S1 which corresponds to said first tensioning force level.

Accordingly the electric motor 6 is driven until a first predetermined maximum value for the motor current is given, for example 1.5 A.

Figure 3B:
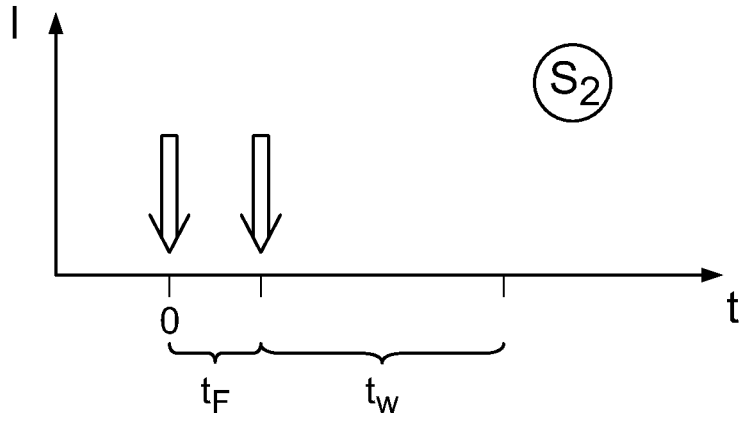
FIG. 3*b* shows a schematic depiction of a second closing signal for the rotating closure and FIG. 3*c* shows a schematic depiction of a third closing signal for the rotating closure.

When the user wants to put on the shoe at his foot with a second (medium) tensioning force level he taps twice onto the closing button 7. This sequence of tap impulses is denoted in FIG. 3*b* with the arrows. The control system 8 registers again the tap impulses wherein intended double impulses—as shown in FIG. 3*b*—can be identified by the fact that they follow within a predetermined following time tF. Otherwise the control system waits again the waiting time tW after the last identified tap impulse to find out if still further tap impulses follow by the user. If this is not the case the software which is stored in the control system 8 knows that the user wanted to give said second closing signal S2 which corresponds to said second tensioning force level.

Accordingly the electric motor 6 is driven now until a second predetermined maximum value for the motor current is given which is higher than the first value, for example 2.5 A.

Figure 3C:
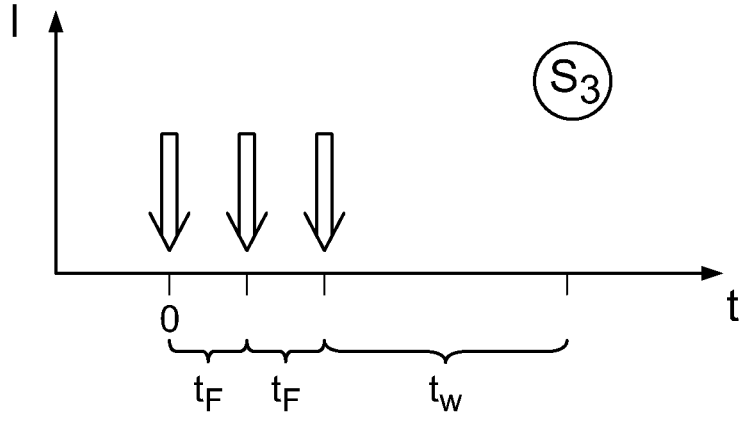

The analogue applies, when the user wants to put on the shoe at his foot with a third (high) tensioning force level. He taps in this case three times onto the closing button 7. This sequence of tap impulses is denoted in FIG. 3*c* with the arrows. The control system 8 registers again the tap impulses wherein intended multiple impulse—as shown in FIG. 3*c*—can be identified by the fact that the time distance between two tap impulses is within the predetermined following time tF. Otherwise the control system waits again the waiting time tW after the last identified tap impulse to find out if still further tap impulses follow by the user. If this is not the case the software which is stored in the control system 8 knows that the user wanted to give said third closing signal S3 which corresponds to said third tensioning force level.

Accordingly the electric motor 6 is driven now until a third predetermined maximum value for the motor current is given which is higher than the second value, for example 3.5 A.

Accordingly the possibility exists by the proposed proceedings to reach a selective tensioning force level by different closing signals S1, S2 and S3 respectively.

The user needs not—as in the state of the art—actuate the closing button 7 for a longer time; rather it is sufficient that he gives the respective sequence of impulses. Furthermore, the user can thereby directly obtain a tensioning force level which fits to his desires without adjusting the same by a respective long pressing of the closing button.

When the shoe fits at least with the first tensioning force level at the foot of the user and when the user presses once onto the closing button 7, when he thus gives a single tap impulse onto the button, the next tensioning force level can be automatically obtained according to a further embodiment, thus from the first into the second tensioning force level or from the second into the third tensioning force level. This is mentioned above when reciting the further closing signal which is applied in the given case by the user to the closing button.

For opening of the shoe, i.e. for releasing of the tensioning element 4, the user presses once onto the opening button 9. The electric motor 6 drives then into the completely tensionless state which can detected by a respective rotation angle sensor at the tensioning roller 5.

LIST OF REFERENCES

1 Shoe
2 Upper
3 Rotating closure
4 Tensioning element
5 Tensioning roller
6 Electric motor
7 Closing button
8 Control system
9 Opening button
10 Instep
11 Sole
S1 First closing signal
S2 Second closing signal
S3 Third closing signal
S4 Further closing signal
tW Waiting time
tF Following time

We claim:

1. A shoe, comprising:

an upper having a closure mechanism that is arranged for lacing the shoe by at least one tensioning element, a rotatably arranged tensioning roller disposed within the closure mechanism, wherein the tensioning roller is driven by an electric motor, and at least one button in communication with a control system for generating a closing signal, which is configured to actuate the electric motor to lace the shoe, wherein the closure mechanism is configured to:

tighten the shoe with a first level of lacing power when a first closing signal is generated that results in a first tension of the at least one tensioning element, wherein the first closing signal is a single tap on the at least one button, which is followed by a first predetermined waiting time, after which the electric motor rotates the tensioning roller to achieve the first tension, and tighten the shoe with a second level of lacing power when a second closing signal is generated that results in a second tension of the at least one tensioning element that is different than the first tension, wherein the second closing signal is a double tap on the at least one button, wherein the double tap occurs within a predetermined following time, and is followed by a second predetermined waiting time, after which the electric motor rotates the tensioning roller to achieve the second tension, wherein the predetermined following time is less than the first predetermined waiting time and the second predetermined waiting time.

2. The shoe of claim 1, wherein the closure mechanism is further configured to tighten the shoe with a third level of lacing power, resulting in a third tension of the at least one tensioning element, which is higher than the second tension, when a third closing signal is generated, which is different from the first and second closing signal.

3. The shoe of claim 2, wherein the third closing signal is a triple tap on the at least one button.

4. The shoe of claim 2, wherein the closure mechanism is further configured to increase the level of lacing power from the first level of lacing power to the second level of lacing power or from the second level of lacing power to the third level of lacing power when a further closing signal is generated by the at least one button.

5. The shoe of claim 1, wherein the first predetermined waiting time or the second predetermined waiting time are at the most 1.0 second.

6. The shoe of claim 1, wherein the predetermined following time is between 0.05 seconds and 0.75 seconds.

7. The shoe of claim 1, wherein the at least one button includes a closing button and an opening button, and wherein the control system initiates tension relief of the at least one tensioning element when the opening button is actuated, which is different from the closing button.

8. The shoe of claim 1, wherein the closure mechanism is arranged on an instep of the shoe.

9. The shoe of claim 7, wherein the control system is coupled with a mobile phone via a wireless connection, and wherein the closing button and opening button are formed by the mobile phone.

10. The shoe of claim 1, wherein the first predetermined waiting time and the second predetermined waiting time are the same.

11. A shoe, comprising:

an upper;

a closure mechanism that is arranged for lacing the shoe by at least one tensioning element, a rotatably arranged tensioning roller disposed within the closure mechanism, wherein the tensioning roller is driven by an electric motor, and at least one button that is in communication with a control system for generating a closing signal, which is configured to actuate the electric motor to lace the shoe, wherein the closure mechanism is configured to:

tighten the shoe when a first closing signal is generated that results in a first tension of the at least one tensioning element, wherein the first closing signal is a single tap on the at least one button, which is followed by a first predetermined waiting time, after which the electric motor rotates the tensioning roller to achieve the first tension, and tighten the shoe when a second closing signal is generated that results in a second tension of the at least one tensioning element that is different than the first tension, wherein the second closing signal is a double tap on the at least one button, wherein the double tap occurs within a predetermined following time, and is followed by a second predetermined waiting time, after which the electric motor rotates the tensioning roller to achieve the second tension, wherein the predetermined following time is less than the first predetermined waiting time and the second predetermined waiting time.

12. The shoe of claim 11, wherein the closure mechanism is further configured to tighten the shoe when a third closing signal is generated that results in a third tension of the at least one tensioning element, the third tension being different than the second tension.

13. The shoe of claim 12, wherein the third closing signal is a triple tap on the at least one button.

14. The shoe of claim 11, wherein the first predetermined waiting time or the second predetermined waiting time are at the most 1.0 second, and wherein the predetermined following time is between 0.05 seconds and 0.75 seconds.

15. The shoe of claim 11, wherein the at least one button includes a closing button and an opening button, and wherein the control system initiates tension relief of the at least one tensioning element when the opening button is actuated, which is different from the closing button.

16. The shoe of claim 15, wherein the control system is coupled with a mobile phone via a wireless connection, and wherein the closing button and opening button are formed by the mobile phone.

17. The shoe of claim 15, wherein the closing button and the opening button are disposed on a lateral side of the shoe and a medial side of the shoe, respectively.

18. The shoe of claim 11, wherein the at least one button is defined by a portion of the shoe that is configured to receive a physical tapping gesture.

19. The shoe of claim 11, wherein the closure mechanism is arranged on an instep of the shoe.

20. The shoe of claim 11, wherein the at least one button includes a closing switch.

21. The shoe of claim 20, wherein after receiving the second closing signal and waiting the second predetermined waiting time, the closing switch is configured to receive a third closing signal.

* * * * *